US011250773B2

(12) United States Patent
Pyo et al.

(10) Patent No.: US 11,250,773 B2
(45) **Date of Patent: *Feb. 15, 2022**

(54) GAMMA CORRECTION DEVICE FOR A DISPLAY DEVICE, GAMMA CORRECTION METHOD FOR A DISPLAY DEVICE, AND DISPLAY DEVICE

(71) Applicant: SAMSUNG DISPLAY CO., LTD., Yongin-si (KR)

(72) Inventors: Si-Beak Pyo, Cheonan-si (KR); Yunki Baek, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,253

(22) Filed: Jun. 23, 2020

(65) Prior Publication Data

US 2020/0320929 A1 Oct. 8, 2020

Related U.S. Application Data

(63) Continuation of application No. 16/389,036, filed on Apr. 19, 2019, now Pat. No. 10,733,932.

(30) Foreign Application Priority Data

Apr. 24, 2018 (KR) ..... 10-2018-0047469

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2320/0626* (2013.01);
(Continued)

(58) Field of Classification Search
CPC ..... G09G 3/3225; G09G 3/2003; G09G 2320/0626; G09G 2320/0666;
(Continued)

(56) References Cited

U.S. PATENT DOCUMENTS 9,013,519 B2 4/2015 Park et al.
9,460,657 B2 10/2016 Pyo
(Continued)

FOREIGN PATENT DOCUMENTS

CN 103198779 7/2013
KR 1020150139014 12/2015
(Continued)

*Primary Examiner* — Premal R Patel
(74) *Attorney, Agent, or Firm* — F. Chau & Associates, LLC

(57) ABSTRACT

A display device includes a display panel including a plurality of pixels, a reference gray mapping table configured to store reference gray mapping information indicating gamma correction reference gray levels to which reference gray levels are mapped, a gray mapper configured to map original gray levels indicated by input data to gamma correction gray levels using the reference gray mapping information stored in the reference gray mapping table, a dither configured to generate dithered output data to represent the gamma correction gray levels using the original gray levels, where a number of bits representing each of the gamma correction gray levels is greater than a number of bits representing each of the original gray levels, and a data driver configured to drive the display panel using the dithered output data.

19 Claims, 13 Drawing Sheets

(52) U.S. Cl.
CPC ..... *G09G 2320/0666* (2013.01); *G09G 2320/0673* (2013.01)

(58) Field of Classification Search
CPC ..... G09G 2320/0673; G09G 3/3208; G09G 2320/0252; G09G 2330/10; G09G 2360/145; G09G 2320/029; G09G 3/2044; G09G 2320/0276
See application file for complete search history.

(56) References Cited

U.S. PATENT DOCUMENTS

| | | | | |
|---|---|---|---|---|
| 2006/0164355 | A1 | 7/2006 | Kim et al. | |
| 2010/0141559 | A1 | 6/2010 | Hwang | |
| 2012/0249405 | A1 | 10/2012 | Park et al. | |
| 2013/0120659 | A1 | 5/2013 | Park et al. | |
| 2013/0155129 | A1 | 6/2013 | Park et al. | |
| 2013/0342585 | A1 | 12/2013 | Chun et al. | |
| 2015/0097764 | A1 | 4/2015 | Pyo et al. | |
| 2015/0287350 | A1* | 10/2015 | Jun ..... | G09G 3/006 345/690 |
| 2016/0019849 | A1 | 1/2016 | Chang et al. | |
| 2016/0049113 | A1 | 2/2016 | Park | |
| 2016/0104408 | A1 | 4/2016 | Kim et al. | |
| 2016/0189676 | A1 | 6/2016 | Pyo | |
| 2017/0011682 | A1 | 1/2017 | Pyo et al. | |
| 2019/0325821 | A1 | 10/2019 | Pyo et al. | |

FOREIGN PATENT DOCUMENTS

| | | |
|---|---|---|
| KR | 1020160081240 | 7/2016 |
| KR | 1020170087088 | 7/2017 |

* cited by examiner

FIG. 3A

| REFERENCE GRAY LEVEL | MEASURED LUMINANCE |
|---|---|
| 0 | 0 |
| 1 | 0.0131 |
| 3 | 0.0803 |
| 7 | 0.2947 |
| 12 | 0.8748 |
| 24 | 3.6745 |
| 37 | 9.6883 |
| 54 | 21.8432 |
| 92 | 70.9473 |
| 160 | 232.9655 |
| 215 | 447.9854 |
| 255 | 649.5471 |

FIG. 3B

300

| | UPSCALED GRAY LEVEL | UPSCALED GRAY LUMINANCE | |
|---|---|---|---|
| 310 | 0.000 | 0.0000 | 330 |
| | 0.125 | 0.0016 | |
| | 0.250 | 0.0033 | |
| | 0.375 | 0.0049 | |
| 350 | 0.500 | 0.0066 | 370 |
| | 0.625 | 0.0082 | |
| | 0.750 | 0.0098 | |
| | 0.875 | 0.0115 | |
| 311 | 1.000 | 0.0131 | 331 |
| | ··· | ··· | |
| 351 | 1.750 | 0.0383 | 371 |
| | ··· | ··· | |
| 312 | 3.000 | 0.0803 | 332 |
| | ··· | ··· | |
| | 6.000 | 0.2411 | |
| | ··· | ··· | |
| 313 | 7.000 | 0.2947 | 333 |
| | ··· | ··· | |
| | 11.250 | 0.7878 | |
| | ··· | ··· | |
| 314 | 12.000 | 0.8748 | 334 |
| | ··· | ··· | |
| | 23.625 | 3.5870 | |

300

| | UPSCALED GRAY LEVEL | UPSCALED GRAY LUMINANCE | |
|---|---|---|---|
| | ··· | ··· | |
| 315 | 24.000 | 3.6745 | 335 |
| | ··· | ··· | |
| | 36.125 | 9.2835 | |
| | ··· | ··· | |
| 316 | 37.000 | 9.6883 | 336 |
| | ··· | ··· | |
| | 53.375 | 21.3963 | |
| | ··· | ··· | |
| 317 | 54.000 | 21.8432 | 337 |
| | ··· | ··· | |
| | 90.500 | 69.0090 | |
| | ··· | ··· | |
| 318 | 92.000 | 70.9473 | 338 |
| | ··· | ··· | |
| 319 | 160.000 | 232.9655 | 339 |
| | ··· | ··· | |
| | 214.500 | 446.0307 | |
| | ··· | ··· | |
| 320 | 215.000 | 447.9854 | 340 |
| | ··· | ··· | |
| 321 | 255.000 | 649.5471 | 341 |

FIG. 4

| REFERENCE GRAY LEVEL | TARGET GAMMA VALUE | TARGET LUMINANCE |
|---|---|---|
| 0 | 2.2 | 0 |
| 1 | | 649.5471*(1/255)^2.2 = 0.0033 |
| 3 | | 649.5471*(3/255)^2.2 = 0.0370 |
| 7 | | 649.5471*(7/255)^2.2 = 0.2385 |
| 12 | | 649.5471*(12/255)^2.2 = 0.7806 |
| 24 | | 649.5471*(24/255)^2.2 = 3.5866 |
| 37 | | 649.5471*(37/255)^2.2 = 9.2954 |
| 54 | | 649.5471*(54/255)^2.2 = 21.3545 |
| 92 | | 649.5471*(92/255)^2.2 = 68.9534 |
| 160 | | 649.5471*(160/255)^2.2 = 232.9626 |
| 215 | | 649.5471*(215/255)^2.2 = 446.2589 |
| 255 | | 649.5471 |

FIG. 5

| REFERENCE GRAY LEVEL | TARGET LUMINANCE | CLOSEST LUMINANCE IN LUT | GAMMA CORRECTION REFRENCE GRAY LEVEL |
|---|---|---|---|
| 0 | 0 | 0.0000 | 0.000 |
| 1 | 0.0033 | 0.0033 | 0.250 |
| 3 | 0.0370 | 0.0383 | 1 750 |
| 7 | 0.2385 | 0.2411 | 6.000 |
| 12 | 0.7806 | 0 7878 | 11 250 |
| 24 | 3.5866 | 3.5870 | 23.625 |
| 37 | 9.2954 | 9.2835 | 36 125 |
| 54 | 21.3545 | 21 3963 | 53.375 |
| 92 | 68.9534 | 69.0090 | 90.500 |
| 160 | 232.9626 | 232.9655 | 160.000 |
| 215 | 446.2589 | 446.0307 | 214.500 |
| 255 | 649.5471 | 649.5471 | 255.000 |

FIG. 6

| REFERENCE GRAY LEVEL | GAMMA CORRECTION REFRENCE GRAY LEVEL | SHIFT AMOUNT (VALUE) | SHIFT AMOUNT (STEP) | REFERENCE GRAY MAPPING INFORMATION | |
|---|---|---|---|---|---|
| | | | | SHIFT SIGN BIT | SHIFT AMOUNT BITS |
| 0 | 0.000 | 0.000 | 0 | 0 | 0000000 |
| 1 | 0.250 | -0.750 | -6 | 1 | 0000110 |
| 3 | 1 750 | -1 250 | -10 | 1 | 0001010 |
| 7 | 6.000 | -1 000 | -8 | 1 | 0001000 |
| 12 | 11 250 | -0 750 | -6 | 1 | 0000110 |
| 24 | 23.625 | -0.375 | -3 | 1 | 0000011 |
| 37 | 36.125 | -0.875 | -7 | 1 | 0000111 |
| 54 | 53.375 | -0.625 | -5 | 1 | 0000101 |
| 92 | 90.500 | -1.500 | -12 | 1 | 0001100 |
| 160 | 160.000 | 0.000 | 0 | 0 | 0000000 |
| 215 | 214.500 | -0.500 | -4 | 1 | 0000100 |
| 255 | 255.000 | 0.000 | 0 | 0 | 0000000 |

FIG. 8

| | ORIGINAL GRAY LEVEL | PRIMARY MAPPING RESULT | SECONDARY MAPPING RESULT |
|---|---|---|---|
| 510 | 0 | 0.000 | 0.000 |
| 511 | 1 | 0.250 | 0.250 |
| 530 | 2 | 0.250 + (1.750 - 0.250) * 1/2 = 1.000 | 1.000 |
| 512 | 3 | 1.750 | 1.750 |
| 531 | 4 | 1.750 + (6.000 - 1 750) * 1/4 = 2.813 | 2.875 |
| | 5 | 1.750 + (6.000 - 1.750) * 2/4 = 3.875 | 3.875 |
| | 6 | 1.750 + (6.000 - 1.750) * 3/4 = 4.938 | 5.000 |
| 513 | 7 | 6.000 | 6.000 |
| | ··· | ··· | ··· |
| 514 | 12 | 11.250 | 11.250 |
| | ··· | ··· | ··· |
| 515 | 24 | 23.625 | 23.625 |
| | ··· | ··· | ··· |
| 516 | 37 | 36.125 | 36.125 |
| | ··· | ··· | ··· |
| 517 | 54 | 53.375 | 53.375 |
| | ··· | ··· | ··· |
| 518 | 92 | 90.500 | 90.500 |
| | ··· | ··· | ··· |
| 519 | 160 | 160.000 | 160.000 |
| | ··· | ··· | ··· |
| 520 | 215 | 214.500 | 214.500 |
| | ··· | ··· | ··· |
| 521 | 255 | 255.000 | 255.000 |

GAMMA CORRECTION DEVICE FOR A DISPLAY DEVICE, GAMMA CORRECTION METHOD FOR A DISPLAY DEVICE, AND DISPLAY DEVICE

CROSS-REFERENCE TO RELATED APPLICATION

This application is a continuation application of U.S. patent application Ser. No. 16/389,036 filed Apr. 19, 2019, which claims priority under 35 U.S.C. § 119 to Korean Patent Application No. 10-2018-0047469, filed on Apr. 24, 2018 in the Korean Intellectual Property Office (KIPO), the disclosures of which are incorporated by reference herein in their entirety.

TECHNICAL FIELD

Exemplary embodiments of the inventive concept relate generally to display devices, and more particularly, to display devices, gamma correction devices for the display devices, and gamma correction methods for the display devices.

DISCUSSION OF RELATED ART

When a display device, such as an organic light emitting diode (OLED) display device, is manufactured, an image quality of an end product (i.e., complete product) of the OLED display device may not reach a target quality level because of deviations in the manufacturing process. In this case, the end product may be determined as a defective product, and the defective product may be discarded. However, discarding all end products determined as defective products is not efficient. Therefore, a post-correction for adjusting the image quality of OLED display devices to reach the target quality level may prevent waste and improve efficiency. For example, a multi-time programming (MTP) operation for repeatedly performing the post-correction of luminance and color coordinates for respective pixel circuits may be performed to adjust the image quality of the OLED display devices to reach the target quality level.

However, since measurements of luminances and color coordinates of the OLED display devices are repeatedly performed to correct the luminances and color coordinates in the MTP operation, a takt time of the MTP operation for each OLED display device may be excessively increased.

SUMMARY

According to an exemplary embodiment of the inventive concept, a display device includes a display panel including a plurality of pixels, a reference gray mapping table configured to store reference gray mapping information indicating gamma correction reference gray levels to which reference gray levels are mapped, a gray mapper configured to map original gray levels indicated by input data to gamma correction gray levels using the reference gray mapping information stored in the reference gray mapping table, a dither configured to generate dithered output data to represent the gamma correction gray levels using the original gray levels, where a number of bits representing each of the gamma correction gray levels is greater than a number of bits representing each of the original gray levels, and a data driver configured to drive the display panel using the dithered output data.

In an exemplary embodiment of the inventive concept, the gamma correction reference gray levels may be determined using luminances of the display device measured at the reference gray levels and a target gamma value.

In an exemplary embodiment of the inventive concept, luminances of the display device may be measured at the reference gray levels that are selected among the original gray levels, upscaled gray luminances of the display device respectively corresponding to upscaled gray levels, each of which is represented by a number of bits greater than the number of bits representing each of the original gray levels, may be determined using the luminances measured at the reference gray levels, target luminances of the reference gray levels may be determined using one of the luminances measured at the reference gray levels and a target gamma value, and the gamma correction reference gray levels to which the reference gray levels are mapped may be determined by searching the upscaled gray luminances closest to the target luminances of the reference gray levels.

In an exemplary embodiment of the inventive concept, the upscaled gray luminances, at the upscaled gray levels that are the same as the reference gray levels, may be determined as the luminances measured at the reference gray levels, and the upscaled gray luminances, at the upscaled gray levels between the reference gray levels, may be determined by interpolating the luminances measured at the reference gray levels.

In an exemplary embodiment of the inventive concept, the number of bits representing each of the upscaled gray levels may be determined as a sum of the number of bits representing each of the original gray levels and a number of bits of dithering performed by the dither.

In an exemplary embodiment of the inventive concept, the target luminances of the reference gray levels may be determined using the luminance measured at a maximum reference gray level among the reference gray levels.

In an exemplary embodiment of the inventive concept, the target luminances of the reference gray levels may be determined using an equation, "Ytgt=Ymax*(Gtgt/Gmax)^TGV", where Ytgt represents one of the target luminances of the reference gray level, Ymax represents the luminance measured at the maximum reference gray level, Gtgt represents a target reference gray level, Gmax represents the maximum reference gray level, and TGV represents the target gamma value.

In an exemplary embodiment of the inventive concept, a lookup table storing the upscaled gray luminances respectively corresponding to the upscaled gray levels may be generated using the luminances measured at the reference gray levels, and the upscaled gray levels corresponding to the upscaled gray luminances closest to the target luminances in the lookup table may be determined as the gamma correction reference gray levels to which the reference gray levels are mapped.

In an exemplary embodiment of the inventive concept, the display device may further include a gamma table configured to store gamma correction data indicating gamma reference voltages at the reference gray levels that are selected among the original ray levels, and a gamma voltage generator configured to generate data voltages respectively corresponding to the original gray levels using the gamma correction data stored in the gamma table.

In an exemplary embodiment of the inventive concept, the data driver may receive the data voltages respectively corresponding to the original gray levels from the gamma voltage generator, may receive the dithered output data from the dither, and may provide the pixels with the data voltages indicated by the dithered output data.

In an exemplary embodiment of the inventive concept, the reference gray mapping table may store, as the reference gray mapping information, a shift sign bit and shift amount bits with respect to each of the reference gray levels.

In an exemplary embodiment of the inventive concept, the gray mapper may map the reference gray levels among the original gray levels to the gamma correction reference gray levels using the reference gray mapping information, and may determine the gamma correction gray levels, to which the original gray levels between the reference gray levels are mapped, by interpolating the gamma correction reference gray levels.

In an exemplary embodiment of the inventive concept, if a result value of the interpolation for the gamma correction reference gray levels is not representable by the dither, the gray mapper may determine a gray level closest to the result value of the interpolation, among gray levels representable by the dither, as a corresponding gamma correction gray level.

In an exemplary embodiment of the inventive concept, the gray mapper may include a primary mapping calculator configured to map the reference gray levels to the gamma correction reference gray levels using the reference gray mapping information, and to interpolate the gamma correction reference gray levels to determine the gamma correction gray levels to which the original gray levels between the reference gray levels are mapped, and a secondary mapping calculator configured to determine gray levels closest to result values of the interpolation among gray levels representable by the dither as the gamma correction gray levels to which the original gray levels between the reference gray levels are mapped.

In an exemplary embodiment of the inventive concept, the display device may further include a gamma flattener configured to perform a gamma flattening operation on the input data.

According to an exemplary embodiment of the inventive concept, a gamma correction device for a display device includes a luminance measurer configured to measure luminances of the display device at reference gray levels selected among original gray levels, a gamma reference voltage determiner configured to determine gamma reference voltages at the reference gray levels using the measured luminances, a lookup table generator configured to generate a lookup table storing upscaled gray luminances of the display device respectively corresponding to upscaled gray levels using the luminances measured at the reference gray levels, where a number of bits representing each of the upscaled gray levels is greater than a number of bits representing each of the original gray levels, a target luminance determiner configured to determine target luminances of the reference gray levels using one of the luminances measured at the reference gray levels and a target gamma value, and a gamma correction reference gray determiner configured to determine gamma correction reference gray levels to which the reference gray levels are mapped by searching the upscaled gray luminances closest to the target luminances of the reference gray levels in the lookup table.

In an exemplary embodiment of the inventive concept, the lookup table generator may determine the upscaled gray luminances, at the upscaled gray levels that are the same as the reference gray levels, as the luminances measured at the reference gray levels, and may determine the upscaled gray luminances, at the upscaled gray levels between the reference gray levels, by interpolating the luminances measured at the reference gray levels.

In an exemplary embodiment of the inventive concept, the number of bits representing each of the upscaled gray levels may be determined as a sum of the number of bits representing each of the original gray levels and a number of bits of dithering performed in the display device.

In an exemplary embodiment of the inventive concept, the gamma correction device may write gamma correction data, indicating the gamma reference voltages at the reference gray levels, to the display device such that the display device generates data voltages using the gamma reference voltages, and may write reference gray mapping information indicating the gamma correction reference gray levels, to which the reference gray levels are mapped to the display device, such that the display device maps the original gray levels indicated by input data of the display device to gamma correction gray levels using the gamma correction reference gray levels.

According to an exemplary embodiment of the inventive concept, in a gamma correction method for a display device, luminances of the display device are measured at reference gray levels selected among original gray levels, gamma reference voltages at the reference gray levels are determined using the measured luminances, a lookup table storing upscaled gray luminances of the display device respectively corresponding to upscaled gray levels is generated using the luminances measured at the reference gray levels, where a number of bits representing each of the upscaled gray levels is greater than a number of bits representing each of the original gray levels, target luminances of the reference gray levels are determined using one of the luminances measured at the reference gray levels and a target gamma value, and gamma correction reference gray levels to which the reference gray levels are mapped are determined by searching the upscaled gray luminances closest to the target luminances of the reference gray levels in the lookup table.

BRIEF DESCRIPTION OF THE DRAWINGS

The above and other features of the inventive concept will be more clearly understood by describing in detail exemplary embodiments thereof with reference to the accompanying drawings.

FIG. 3A is a diagram illustrating an example of luminances measured at reference gray levels, and FIG. 3B is a diagram illustrating an example of a lookup table generated based on the measured luminances in FIG. 3A according to an exemplary embodiment of the inventive concept.

FIG. 4 is a diagram for describing an example of determining target luminances at reference gray levels according to an exemplary embodiment of the inventive concept.

FIG. 5 is a diagram for describing an example of determining gamma correction reference gray levels to which reference gray levels are mapped according to an exemplary embodiment of the inventive concept.

FIG. 6 is a diagram for describing reference gray mapping information indicating gamma correction reference gray levels to which reference gray levels are mapped according to an exemplary embodiment of the inventive concept.

FIG. 8 is a diagram for describing an example of primary mapping and secondary mapping performed by the display device of FIG. 7 according to an exemplary embodiment of the inventive concept.

DETAILED DESCRIPTION OF THE EMBODIMENTS

Figure 1:
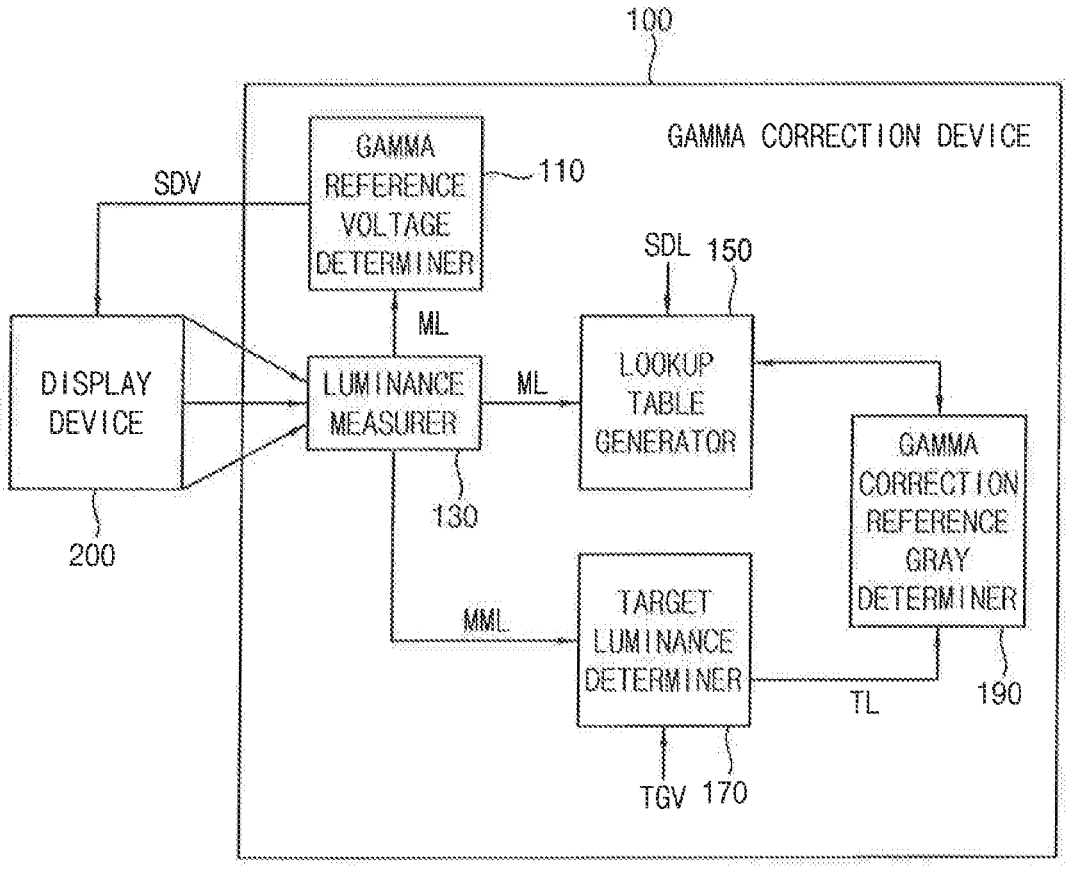
FIG. 1 is a block diagram illustrating a gamma correction device according to an exemplary embodiment of the inventive concept.

Exemplary embodiments of the inventive concept provide a display device having an improved gamma characteristic and an improved image quality.

Exemplary embodiments of the inventive concept also provide a gamma correction device capable of improving a gamma characteristic and an image quality of a display device.

Exemplary embodiments of the inventive concept further provide a gamma correction method capable of improving a gamma characteristic and an image quality of a display device.

Exemplary embodiments of the inventive concept are described more fully hereinafter with reference to the accompanying drawings. Like or similar reference numerals may refer to like or similar elements throughout this application.

FIG. 1 is a block diagram illustrating a gamma correction device according to an exemplary embodiment of the inventive concept.

Referring to FIG. 1, a gamma correction device 100 for a display device 200 according to an exemplary embodiment of the inventive concept may include a gamma reference voltage determiner 110, a luminance measurer 130, a lookup table generator 150, a target luminance determiner 170, and a gamma correction reference gray determiner 190.

The gamma reference voltage determiner 110 may provide the display device 200 with data voltage signals SDV having predicted voltage levels of gamma reference voltages at reference gray levels (e.g., tab-points) selected among original gray levels. For example, the original gray levels may include 256 gray levels from a 0-gray level to a 255-gray level, and the reference gray levels may be selected among the 256 gray levels. The luminance measurer 130 may measure luminances (and/or color coordinates) of the display device 200 at the reference gray levels. The gamma reference voltage determiner 110 may receive measured luminances ML from the luminance measurer 130, and may determine whether the measured luminances ML (and/or the measured color coordinates) are within a desired target range.

If the measured luminances ML are not within the desired target range, the gamma reference voltage determiner 110 may provide the display device 200 with the data voltage signals SDV having adjusted voltage levels, and may again measure the luminance of the display device 200 at the adjusted voltage levels using the luminance measurer 130. Alternatively, if the measured luminances ML are within the desired target range, the gamma reference voltage determiner 110 may determine the voltage levels of the data voltage signals SDV applied to the display device 200 as voltage levels of the gamma reference voltages at the reference gray levels. This operation that determines the gamma reference voltages by repeatedly performing the data voltage adjustment and the luminance measurement may be referred to as a multi-time programming (MTP) operation.

In an exemplary embodiment of the inventive concept, the MTP operation (and an auto micro-adjusting gamma (AMG) operation described below) may be performed on the display device 200 when the display device 200 is in a module state. In the module state, the display device 200 may be a display panel that is scribed from a mother substrate (or a one-sheet substrate) at which a plurality of display panels are formed. Further, in an exemplary embodiment of the inventive concept, the MTP operation may be performed with respect to each of a plurality of luminance levels or each of a plurality of dimming levels.

The lookup table generator 150 may generate a lookup table storing upscaled gray luminances of the display device 200 respectively corresponding to upscaled gray levels based on the measured luminances ML measured at the reference gray levels during the MTP operation (or the measured luminances ML measured when the gamma reference voltages are determined). The number of bits representing each of the upscaled gray levels may be greater than the number of bits representing each of the original gray levels. For example, each original gray level may be represented by 8 bits which represent one of 256 gray levels from 0-gray level to 255-gray level with an interval of 1, and each upscaled gray level may be represented by 11 bits which represent one of 2041 gray levels from 0.000-gray level to 255.000-gray level with an interval of 0.125. In an exemplary embodiment of the inventive concept, the number of bits representing each upscaled gray level may be determined by considering a dithering level of the display device 200. In other words, the number of bits representing each upscaled gray level may be determined as a sum of the number of bits representing each original gray level and the number of bits of dithering performed in the display device 200. For example, in a case where each original gray level is represented by 8 bits, and the display device 200 performs 3-bit dithering, each upscaled gray level may be represented by 11 bits.

In an exemplary embodiment of the inventive concept, the lookup table generator 150 may determine the upscaled gray luminances, at the upscaled gray levels that are the same as the reference gray levels, as the measured luminances ML measured at the reference gray levels, and may determine the upscaled gray luminances, at the upscaled gray levels between the reference gray levels, by interpolating the measured luminances ML measured at the reference gray levels. For example, in a case where the reference gray levels include 1-gray level and 3-gray level, the measured luminance ML measured at the 1-gray level is 0.0131 nit, and the measured luminance ML measured at the 3-gray level is 0.0803 nit, the lookup table may store 0.0131 nit as the upscaled gray luminance corresponding to the upscaled gray level of 1.000-gray level, may store 0.0803 nit as the upscaled gray luminance corresponding to the upscaled gray level of 3.000-gray level, and may store about 0.0173 nit ($=0.0131+(0.0803-0.0131)*(1/16)$) as the upscaled gray luminance corresponding to 1.125-gray level that is one of the upscaled gray levels between the 1.000-gray level and the 3.000-gray level.

The target luminance determiner 170 may determine target luminances TL of the reference gray levels based on a luminance MML of the measured luminances ML measured at the reference gray levels and a target gamma value TGV. In an exemplary embodiment of the inventive concept, the target luminances TL of the reference gray levels may be determined based on the luminance MML measured at the maximum reference gray level (e.g., 255-gray level) among the reference gray levels.

In an exemplary embodiment of the inventive concept, the target luminance determiner 170 may determine the target luminances TL of the reference gray levels using an equation, "Ytgt=Ymax*(Gtgt/Gmax)^TGV". Here, Ytgt represents the target luminance TL of the reference gray level, Ymax represents the luminance MML measured at the maximum reference gray level, Gtgt represents the reference gray level, Gmax represents the maximum reference gray level, and TGV represents the target gamma value. For example, in a case where the luminance MML measured at the 255-gray level is 649.5471 nit, and the target gamma value TGV is 2.2, the target luminance TL of 3-gray level that is one of the reference gray levels may be determined as "649.5471*(3/255)^2.2=0.0370 nit".

The gamma correction reference gray determiner 190 may determine gamma correction reference gray levels to which the reference gray levels are mapped by searching the upscaled gray luminances closest to the target luminances TL of the reference gray levels in the lookup table generated by the lookup table generator 150. In an exemplary embodiment of the inventive concept, the gamma correction reference gray determiner 190 may search the upscaled gray luminances closest to the target luminances TL of the reference gray levels in the lookup table, and may determine the upscaled gray levels corresponding to the searched upscaled gray luminances as the gamma correction reference gray levels to which the reference gray levels are mapped. For example, with respect to the 3-gray level that is one of the reference gray levels, the gamma correction reference gray determiner 190 may search the upscaled gray luminance closest to 0.0370 nit that is the target luminance TL of the 3-gray level among the upscaled gray luminances stored in the lookup table. In a case where the upscaled gray luminance closest to 0.0370 nit is 0.0383 nit, the gamma correction reference gray determiner 190 may determine the upscaled gray level (e.g., 1.750-gray level) corresponding to the 0.0383 nit, among the upscaled gray levels stored in the lookup table, as the gamma correction reference gray level to which the 3-gray level is mapped.

As described above, the gamma correction device 100 may generate the lookup table storing the upscaled gray luminances corresponding to the upscaled gray levels where the dithering level of the display device 200 is considered based on the measured luminances ML measured during the MTP operation, and may perform an operation that maps (or adjusts) each reference gray level to the upscaled gray level corresponding to the target luminance TL by searching the target luminance TL of the reference gray level corresponding to the target gamma value TGV in the lookup table. This operation that adjusts the reference gray levels to correspond to the target gamma value TGV may be referred to an auto micro-adjusting gamma (AMG) operation.

The gamma correction device 100 may write gamma correction data generated by the MTP operation to the display device 200, and may write reference gray mapping information generated by the AMG operation to the display device 200. The gamma correction data may indicate the gamma reference voltages at the reference gray levels, and the reference gray mapping information may indicate the gamma correction reference gray levels to which the reference gray levels are mapped. The display device 200 may generate data voltages corresponding to the gamma reference voltages, or gamma corrected data voltages based on the gamma correction data, and may map the original gray levels indicated by input data of the display device 200 to gamma correction gray levels including the gamma correction reference gray levels based on the reference gray mapping information to further correspond to the target gamma value TGV.

For example, when the input data indicating the 3-gray level are received, the display device 200 may map the 3-gray level to the 1.750-gray level such that the display device 200 emits light not with 0.0803 nit that is the measured luminance ML measured at the 3-gray level, but with 0.0383 nit corresponding to the 1.750-gray level closest to the 0.0370 nit that is the target luminance TL of the 3-gray level determined based on the target gamma value TGV. Accordingly, the display device 200 may have a gamma characteristic corresponding to the target gamma value TGV, and may have an improved image quality.

Figure 2:
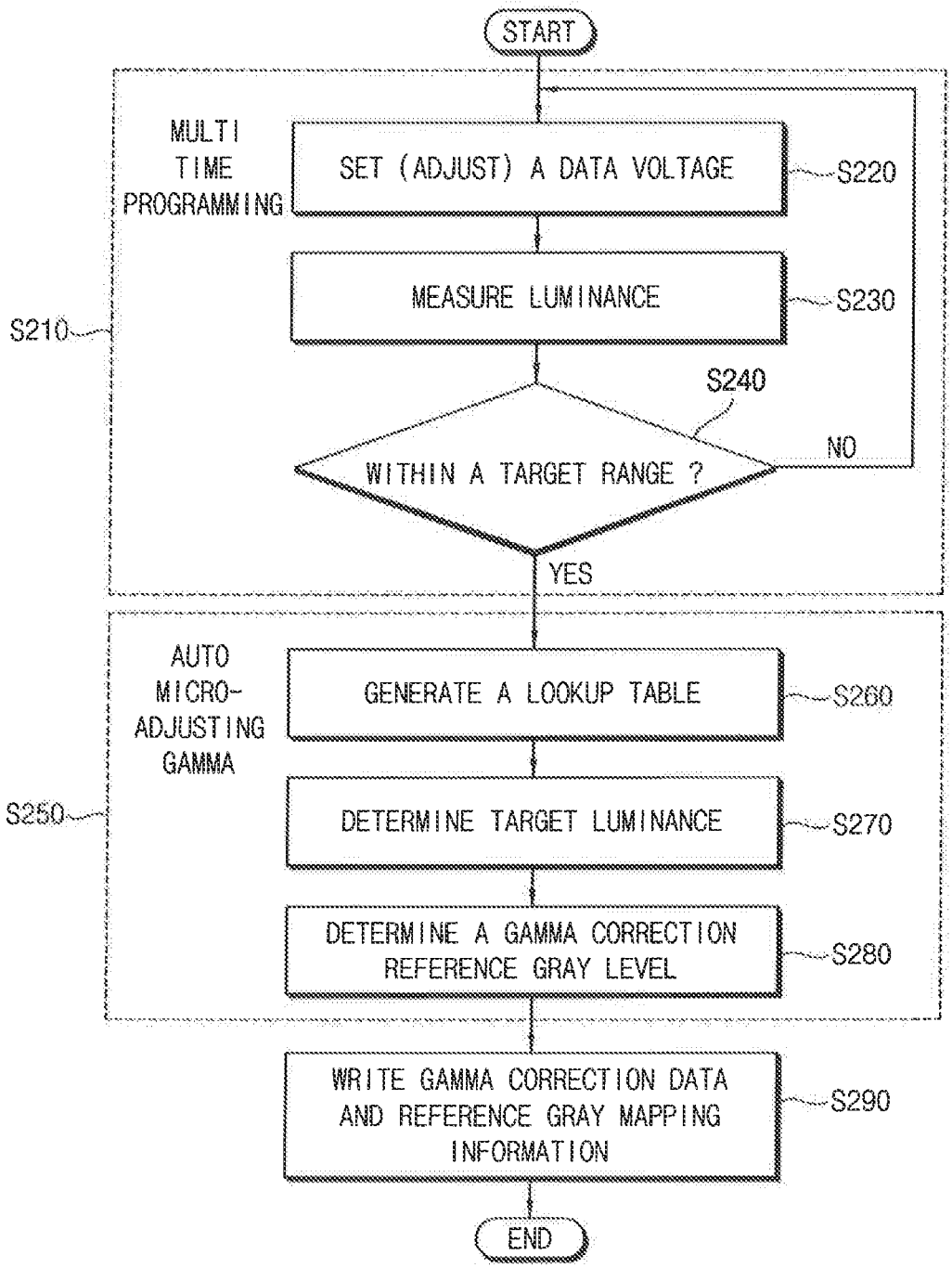
FIG. 2 is a flowchart illustrating a gamma correction method according to an exemplary embodiment of the inventive concept.

FIG. 2 is a flowchart illustrating a gamma correction method according to an exemplary embodiment of the inventive concept, FIG. 3A is a diagram illustrating an example of luminances measured at reference gray levels according to an exemplary embodiment of the inventive concept, FIG. 3B is a diagram illustrating an example of a lookup table generated based on the measured luminances in FIG. 3A according to an exemplary embodiment of the inventive concept, FIG. 4 is a diagram for describing an example of determining target luminances at reference gray levels according to an exemplary embodiment of the inventive concept, FIG. 5 is a diagram for describing an example of determining gamma correction reference gray levels to which reference gray levels are mapped according to an exemplary embodiment of the inventive concept, and FIG. 6 is a diagram for describing reference gray mapping information indicating gamma correction reference gray levels to which reference gray levels are mapped according to an exemplary embodiment of the inventive concept.

Referring to FIGS. 1 and 2, the gamma correction device 100 according to an exemplary embodiment of the inventive concept may perform the MTP operation that determines gamma reference voltages respectively corresponding to reference gray levels by repeatedly performing data voltage adjustments and luminance measurements with respect to each of the reference gray levels (S210), and may perform the AMG operation that adjusts the reference gray levels to gamma correction reference gray levels so that the display device 200 may have an improved gamma characteristic (S250).

To perform the MTP operation (S210), the gamma reference voltage determiner 110 may set a data voltage at each reference gray level to a predicted voltage level of the gamma reference voltage (S220), and the luminance measurer 130 may measure a luminance of the display device 200 emitting light in response to the set data voltage (S230). The gamma reference voltage determiner 110 may determine whether the measured luminance ML is within a desired target range (S240). If the measured luminance ML exceeds the target range (S240: NO), the gamma reference voltage determiner 110 may adjust the data voltage (S220), and the luminance measurer 130 may again measure the luminance of the display device 200 emitting light in response to the adjusted data voltage (S230).

If the measured luminance ML is within the target range (S240: YES), the gamma reference voltage determiner 110 may determine the data voltage applied to the display device 200 as the gamma reference voltage. The gamma correction device 100 may perform this determination of the gamma reference voltage with respect to each of respective reference gray levels. Further, in an exemplary embodiment of the inventive concept, the gamma correction device 100 may perform the determinations of the gamma reference voltages with respect to each of respective luminance levels (or respective dimming levels).

To perform the AMG operation after the MTP operation (S250), the lookup table generator 150 may generate a lookup table storing upscaled gray luminances corresponding to upscaled gray levels each of which is represented by a number of bits greater than a number of bits representing each of original gray levels based on the measured luminances ML measured at the reference gray levels during the MTP operation (S260). In an exemplary embodiment of the inventive concept, the number of bits representing each of the upscaled gray levels may be determined as a sum of the number of bits representing each of the original gray levels and the number of bits of dithering performed in the display device 200.

In an exemplary embodiment of the inventive concept, the lookup table generator 150 may determine the upscaled gray luminances, at the upscaled gray levels that are the same as the reference gray levels, as the measured luminances ML measured at the reference gray levels, and may determine the upscaled gray luminances, at the upscaled gray levels between the reference gray levels, by interpolating the measured luminances ML measured at the reference gray levels.

For example, as illustrated in FIG. 3A, among the original gray levels from 0-gray level to 255-gray level, 0-gray level, 1-gray level, 3-gray level, 7-gray level, 12-gray level, 24-gray level, 37-gray level, 54-gray level, 92-gray level, 160-gray level, 215-gray level, and 255-gray level may be selected as the reference gray levels. During the MTP operation, the measured luminance ML of the display device 200 may be measured as about 0 nit at the 0-gray level, about 0.0131 nit at the 1-gray level, about 0.0803 nit at the 3-gray level, about 0.2947 nit at the 7-gray level, about 0.8748 nit at the 12-gray level, about 3.6745 nit at the 24-gray level, about 9.6883 nit at the 37-gray level, about 21.8432 nit at the 54-gray level, about 70.9473 nit at the 92-gray level, about 232.9655 nit at the 160-gray level, about 447.9854 nit at the 215-gray level and about 649.5471 nit at the 255-gray level.

In this case, as illustrated in a lookup table 300 of FIG. 3B, the lookup table generator 150 may determine twelve upscaled gray luminances 330 through 341, at twelve upscaled gray levels 310 through 321 that are the same as the twelve reference gray levels, as the measured luminances ML measured at the twelve reference gray levels during the MTP operation. Further, the lookup table generator 150 may determine upscaled gray luminances 370 and 371, at upscaled gray levels 350 and 351 between the twelve reference gray levels, by interpolating the measured luminances ML measured at the twelve reference gray levels. For example, as illustrated in FIG. 3B, in the lookup table 300, the upscaled gray luminances 370, at the upscaled gray levels 350 between the 0-gray level and the 1-gray level, may be determined by linearly interpolating between the 0 nit at the 0-gray level and the 0.0131 nit at the 1-gray level. Similarly, in the lookup table 300, the upscaled gray luminances 371, at the upscaled gray levels 351 between the 1-gray level and the 3-gray level, may be determined by linearly interpolating between the 0.131 nit at the 1-gray level and the 0.0383 nit at the 3-gray level.

The target luminance determiner 170 may determine the target luminances TL of the reference gray levels based on the luminance MML of the measured luminances ML measured at the reference gray levels and the target gamma value TGV (S270). In an exemplary embodiment of the inventive concept, the target luminances TL of the reference gray levels may be determined based on the luminance MML measured at the maximum reference gray level (e.g., 255-gray level) among the reference gray levels. Further, in an exemplary embodiment of the inventive concept, the target luminance determiner 170 may determine the target luminances TL of the reference gray levels using the equation, "Ytgt=Ymax*(Gtgt/Gmax)^TGV", where Ytgt represents the target luminance TL of the reference gray level, Ymax represents the luminance MML measured at the maximum reference gray level, Gtgt represents the reference gray level, Gmax represents the maximum reference gray level, and TGV represents the target gamma value.

For example, as illustrated in FIG. 4, the target luminance TL of the 255-gray level may be determined as 649.5471 nit that is the luminance MML measured at the 255-gray level, and the target luminances TL of the remaining 0, 1, 3, 7, 12, 24, 37, 54, 92, 160, and 215-gray levels may be respectively determined as about 0 nit, about 0.0033 nit, about 0.0370 nit, about 0.2385 nit, about 0.7806 nit, about 3.5866 nit, about 9.2954 nit, about 21.3545 nit, about 68.9534 nit, about 232.9626 nit, and about 446.2589 nit, based on the 649.5471 nit that is the luminance MML measured at the 255-gray level and the target gamma value TGV of 2.2.

The gamma correction reference gray determiner 190 may determine gamma correction reference gray levels to which the reference gray levels are mapped by searching the upscaled gray luminances closest to the target luminances TL of the reference gray levels in the lookup table generated by the lookup table generator 150 (S280). In an exemplary embodiment of the inventive concept, the gamma correction reference gray determiner 190 may search the upscaled gray luminances closest to the target luminances TL of the reference gray levels in the lookup table, and may determine the upscaled gray levels corresponding to the searched upscaled gray luminances as the gamma correction reference gray levels to which the reference gray levels are mapped.

For example, as illustrated in FIGS. 3A and 5, in a case where the target luminance TL of the 1-gray level is 0.0033 nit, the gamma correction reference gray determiner 190 may obtain 0.0033 nit as the upscaled gray luminance closest to the 0.0033 nit from the lookup table 300, and may determine 0.250-gray level, corresponding to the 0.0033 nit in the lookup table 300, as the gamma correction reference gray level to which the 1-gray level is mapped. Further, in a case where the target luminance TL of the 3-gray level is 0.0370 nit, the gamma correction reference gray determiner 190 may obtain 0.0383 nit as the upscaled gray luminance closest to the 0.0370 nit from the lookup table 300, and may determine 1.750-gray level, corresponding to the 0.0383 nit in the lookup table 300, as the gamma correction reference gray level to which the 3-gray level is mapped. In this manner, the gamma correction reference gray determiner 190 may determine 0.000-gray level, 0.250-gray level, 1.750-gray level, 6.000-gray level, 11.250-gray level, 23.625-gray level, 36.125-gray level, 53.375-gray level, 90.500-gray level, 160.000-gray level, 214.500-gray level, and 255.000-gray level as the gamma correction reference gray levels for the 0, 1, 3, 7, 12, 24, 37, 54, 92, 160, 215, and 255-gray levels.

The gamma correction device 100 may write gamma correction data generated by the MTP operation to the display device 200, and may write reference gray mapping information generated by the AMG operation to the display device 200 (S290). The gamma correction data may indicate the gamma reference voltages at the reference gray levels, and the reference gray mapping information may indicate the gamma correction reference gray levels to which the reference gray levels are mapped. For example, the gamma correction data may be stored in the display device 200, in a form of predetermined gamma reference voltages at the reference gray levels and differences (or gamma offsets) between the predetermined gamma reference voltages and the gamma reference voltages determined by the MTP operation. However, the inventive concept is not limited thereto.

In an exemplary embodiment of the inventive concept, the reference gray mapping information may include, with respect to each of the reference gray levels, a shift sign bit indicating whether the reference gray level is to be increased or decreased, and shift amount bits indicating an amount of a change of the reference gray level. For example, as illustrated in FIG. 6, in a case where the 1-gray level is mapped to 0.250-gray level as the gamma correction reference gray level, where the 1-gray level is to be decreased by 0.750 in terms of a gray level value, and where the 1-gray level is to be decreased by 6 steps in the upscaled gray levels having an interval of 0.125, the reference gray mapping information for the 1-gray level may include the shift sign bit of '1' indicating the decrease of the reference gray level, and the shift amount bits may have a value of '0000110' indicating that the reference gray level is to be moved by the 6 steps.

The display device 200 may generate gamma corrected data voltages based on the gamma correction data, and may map the original gray levels of input data to gamma correction gray levels including the gamma correction reference gray levels based on the reference gray mapping information, to further correspond to the target gamma value TGV. Accordingly, the display device 200 may have a gamma characteristic corresponding to the target gamma value TGV, and may have an improved image quality.

Figure 7:
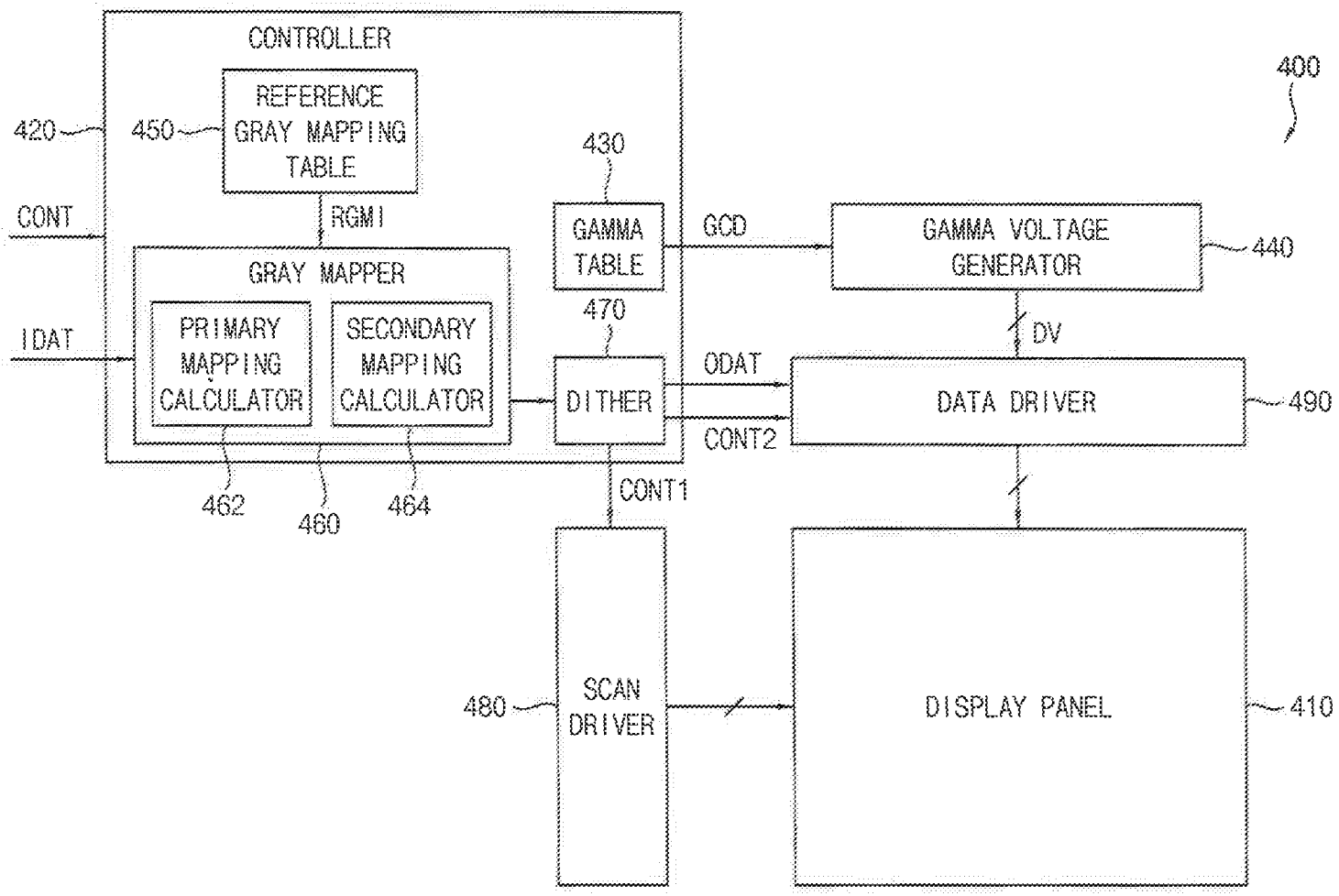
FIG. 7 is a block diagram illustrating a display device according to an exemplary embodiment of the inventive concept.
Figure 9:
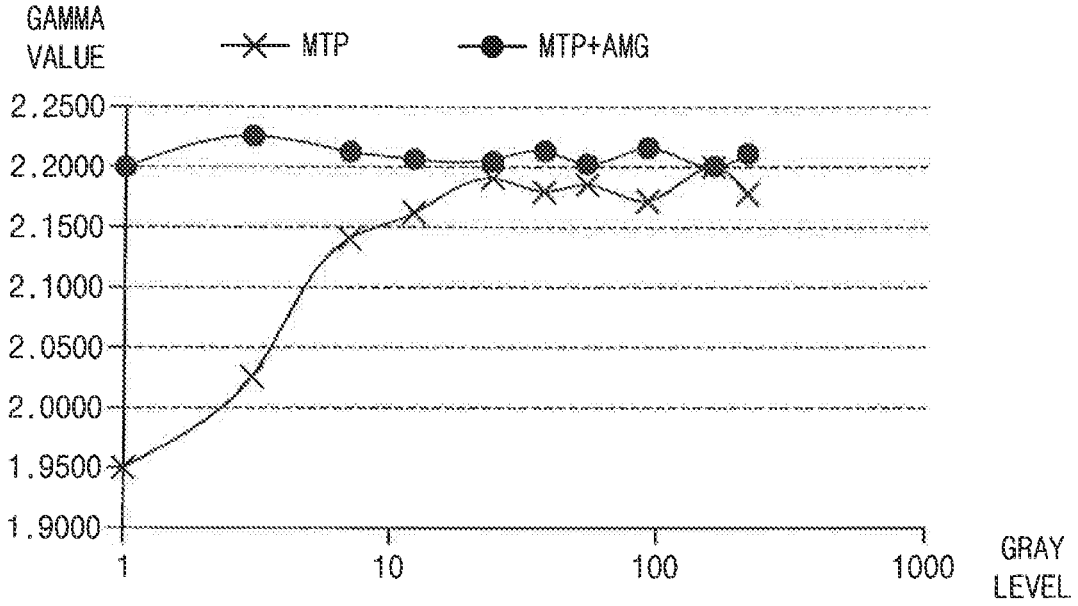
FIG. 9 is a diagram for illustrating a gamma characteristic of the display device of FIG. 7 according to an exemplary embodiment of the inventive concept.

FIG. 7 is a block diagram illustrating a display device according to an exemplary embodiment of the inventive concept, FIG. 8 is a diagram for describing an example of primary mapping and secondary mapping performed by the display device of FIG. 7 according to an exemplary embodiment of the inventive concept, and FIG. 9 is a diagram illustrating a gamma characteristic of the display device of FIG. 7 according to an exemplary embodiment of the inventive concept.

Referring to FIG. 7, a display device 400 may include a display panel 410, a gamma table 430, a gamma voltage generator 440, a reference gray mapping table 450, a gray mapper 460, a dither 470, and a data driver 490. The display device 400 may further include a scan driver 480 which provides scan signals to the display panel 410 based on a scan control signal CONT1 provided from a controller 420, and the controller 420 which controls the gamma voltage generator 440, the scan driver 480, and the data driver 490 based on a control signal CONT and input data IDAT provided from an external host (e.g., a graphic processing unit (GPU)).

The display panel 410 may include a plurality of scan lines, a plurality of data lines, and a plurality of pixels connected to the plurality of scan lines and the plurality of data lines. In an exemplary embodiment of the inventive concept, each pixel may include an organic light emitting diode (OLED), and the display panel 410 may be, but is not limited to, an OLED display panel.

The gamma table 430 may store gamma correction data GCD indicating gamma reference voltages at reference gray levels that are selected among original gray levels (e.g., 256 gray levels from 0-gray level to 255-gray level) represented by the input data IDAT. In an exemplary embodiment of the inventive concept, the gamma correction data GCD may be stored, for example, in a form of predetermined gamma reference voltages at the reference gray levels and differences (or gamma offsets) between the predetermined gamma reference voltages and gamma reference voltages determined by an MTP operation. However, the inventive concept is not limited thereto.

The gamma voltage generator 440 may generate data voltages DV (or gamma voltages) respectively corresponding to the original gray levels based on the gamma correction data GCD stored in the gamma table 430. For example, the gamma voltage generator 440 may generate the gamma reference voltages indicated by the gamma correction data GCD as the data voltages DV at the reference gray levels, and generate the data voltages DV at the original gray levels between the reference gray levels by dividing the gamma reference voltages.

The reference gray mapping table 450 may store reference gray mapping information RGMI indicating gamma correction reference gray levels to which the reference gray levels are mapped. In an exemplary embodiment of the inventive concept, the reference gray mapping table 450 may store, as the reference gray mapping information RGMI for each reference gray level, a shift sign bit indicating whether the reference gray level is to be increased or decreased, and shift amount bits indicating an amount of a change of the reference gray level.

The gray mapper 460 may map the original gray levels indicated by the input data IDAT to gamma correction gray levels based on the reference gray mapping information RGMI stored in the reference gray mapping table 450. The number of bits representing each of the gamma correction gray levels may correspond to a sum of the number of bits representing each of the original gray levels and the number of bits of dithering performed by the dither 470. In an exemplary embodiment of the inventive concept, the gray mapper 460 may map the reference gray levels among the original gray levels to the gamma correction reference gray levels indicated by the reference gray mapping information RGMI, and may determine the gamma correction gray levels, to which the original gray levels between the reference gray levels are mapped, by interpolating the gamma correction reference gray levels. In a case where a result value of the interpolation for the gamma correction reference gray levels is not representable by the dither 470, the gray mapper 460 may determine a gray level closest to the result value of the interpolation, among gray levels representable by the dither 470, as the gamma correction gray level. In an exemplary embodiment of the inventive concept, to perform this operation, the gray mapper 460 may include a primary mapping calculator 462 and a secondary mapping calculator 464. The primary mapping calculator 462 maps the reference gray levels to the gamma correction reference gray levels based on the reference gray mapping information RGMI, and interpolates the gamma correction reference gray levels to determine the gamma correction gray levels to which the original gray levels between the reference gray levels are mapped. The secondary mapping calculator 464 determines gray levels closest to result values of the interpolation, among gray levels representable by the dither 470, as the gamma correction gray levels to which the original gray levels between the reference gray levels are mapped.

For example, as illustrated in FIG. 8, the primary mapping calculator 462 may map reference gray levels 510 through 521 among the original gray levels to the gamma correction reference gray levels indicated by the reference gray mapping information RGMI. Further, the primary mapping calculator 462 may linearly interpolate the gamma correction reference gray levels to determine the gamma correction gray levels to which original gray levels 530 and 531, between the reference gray levels 510 through 521, are mapped. For example, the gamma correction gray level to which the original gray level 530 between 1-gray level 511 and 3-gray level 512 is mapped may be determined by linearly interpolating between 0.250 that is the gamma correction reference gray level of the 1-gray level 511 and 1.750 that is the gamma correction reference gray level of the 3-gray level 512, and the gamma correction gray levels to which the original gray level 531 between 3-gray level 512 and 7-gray level 513 are mapped may be determined by linearly interpolating between 1.750 that is the gamma correction reference gray level of the 3-gray level 512 and 6.000 that is the gamma correction reference gray level of the 7-gray level 513. The secondary mapping calculator 464 may change results of the primary mapping to gray levels representable by the dither 470. For example, in a case where the primary mapping calculator 462 determines 2.813-gray level as the gamma correction gray level to which 4-gray level is mapped, the secondary mapping calculator 464 may change the gamma correction gray level to which the 4-gray level is mapped to 2.875-gray level, which is closest to the 2.813-gray level among the gray levels representable by the dither 470. Accordingly, as illustrated in FIG. 8, the input data IDAT indicating the 1-gray level may be converted by the gray mapper 460 into 0.250-gray level, the input data IDAT indicating the 2-gray level may be converted by the gray mapper 460 into 1.000-gray level, the input data IDAT indicating the 3-gray level may be converted by the gray mapper 460 into 1.750-gray level, the input data IDAT indicating the 4-gray level may be converted by the gray mapper 460 into 2.875-gray level, the input data IDAT indicating the 5-gray level may be converted by the gray mapper 460 into 3.875-gray level, the input data IDAT indicating the 6-gray level may be converted by the gray mapper 460 into 5.000-gray level, and the input data IDAT indicating the 7-gray level may be converted by the gray mapper 460 into 6.000-gray level.

The dither 470 may generate dithered output data ODAT to represent the gamma correction gray levels, each of which is represented by a number of bits greater than the number of bits representing each of the original gray levels, by using the original gray levels. In an exemplary embodiment of the inventive concept, the dither 470 may generate the dithered output data ODAT by performing temporal dithering and/or spatial dithering. For example, the dither 470 may represent the gamma correction gray level of '0.500' by performing temporal dithering that respectively outputs the output data ODAT of 0 and the output data ODAT of 1 in adjacent frames. In another example, the dither 470 may represent the gamma correction gray level of '0.500' by performing spatial dithering that respectively outputs the output data ODAT of 0 and the output data ODAT of 1 with respect to adjacent pixels. Thus, although the output data ODAT may indicate the original gray level with an interval of 1 at one time point with respect to each pixel, the gamma correction gray levels having an interval of, for example, 0.125 may be represented by the temporal dithering and/or the spatial dithering.

The data driver 490 may provide the data voltages DV to the pixels based on the output data ODAT and a data control signal CONT2. For example, the data driver 490 may receive the data voltages DV respectively corresponding to the original gray levels from the gamma voltage generator 440, may receive the dithered output data ODAT representing the gamma correction gray levels using the original gray levels from the dither 470, and may provide the pixels with the data voltages DV corresponding to the original gray levels indicated by the dithered output data ODAT.

For example, in a case where the input data IDAT indicate 3-gray level, the input data IDAT may be converted by the gray mapper 460 into 1.750-gray level. To represent the 1.750-gray level, the dither 470 may generate the output data ODAT indicating 1-gray level at a first frame, and may generate the output data ODAT indicating 2-gray level at second through fourth frames. In this case, the data driver 490 may provide a pixel with the data voltage DV corresponding to the 1-gray level at the first frame, and may provide the pixel with the data voltage DV corresponding to the 2-gray level at the second through fourth frames. Accordingly, when the input data IDAT indicates the 3-gray level, the display device 400 may emit light with a target luminance (or with luminance close to the target luminance) of the 3-gray level determined based on a target gamma value by mapping the 3-gray level to the 1.750-gray level. Thus, the display device 400 may have a gamma characteristic corresponding to the target gamma value, and may have an improved image quality.

For example, as illustrated in FIG. 9, in a case where only the MTP operation is performed on the display device 400, the display device 400 may have a gamma characteristic not corresponding to the target gamma value, and may have a poor gamma characteristic in low gray levels. However, the display device 400 according to an exemplary embodiment of the inventive concept may store not only the gamma correction data GCD generated by the MTP operation, but also the reference gray mapping information RGMI generated by the AMG operation, thus having the gamma characteristic corresponding to the target gamma value.

Although FIG. 7 illustrates an example where the gamma table 430, the reference gray mapping table 450, the gray mapper 460, and the dither 470 are included in the controller 420 (e.g., a timing controller), a configuration of the display device 400 is not limited thereto. For example, at least a portion of the components (e.g., the gamma table 430 and the reference gray mapping table 450) may be implemented outside the controller 420.

Figure 10:
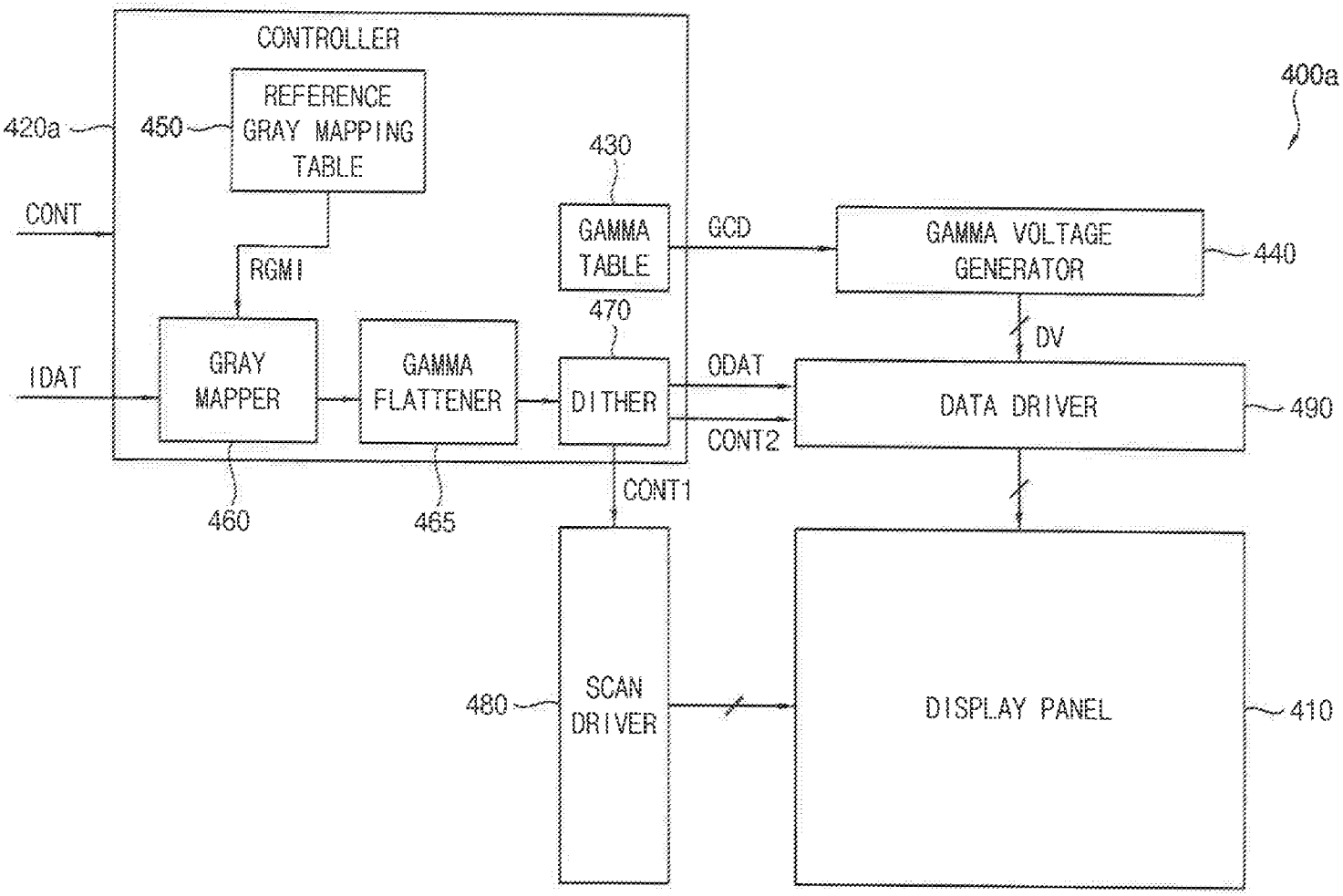
FIG. 10 is a block diagram illustrating a display device according to an exemplary embodiment of the inventive concept.
Figure 11:
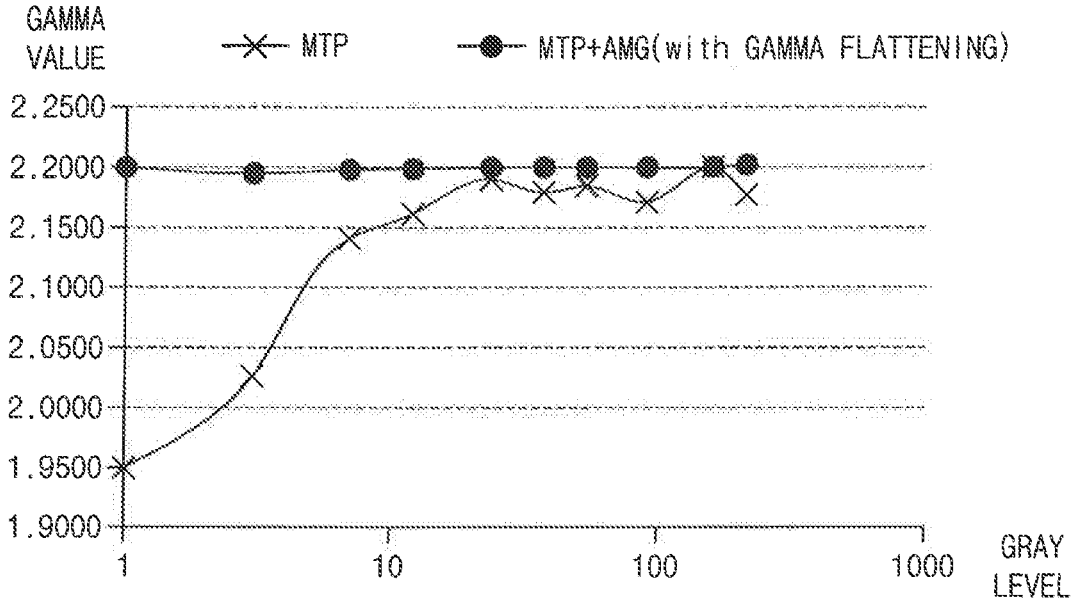
FIG. 11 is a diagram illustrating a gamma characteristic of the display device of FIG. 10 according to an exemplary embodiment of the inventive concept.

FIG. 10 is a block diagram illustrating a display device according to an exemplary embodiment of the inventive concept, and FIG. 11 is a diagram illustrating a gamma characteristic of the display device of FIG. 10 according to an exemplary embodiment of the inventive concept.

A display device 400*a* of FIG. 10 may have substantially the same configuration and operation as the display device 400 of FIG. 7, except that a controller 420*a* further includes a gamma flattener 465.

The gamma flattener 465 may perform a gamma flattening operation on the input data IDAT. For example, the gamma flattener 465 may gradually increase or decrease intervals between reference gray levels of the input data IDAT to improve gamma characteristics between the reference gray levels. Although FIG. 10 illustrates an example where the gamma flattener 465 is disposed after the gray mapper 460, in an exemplary embodiment of the inventive concept, the gamma flattener 465 may be located at a front stage of or before the gray mapper 460 (e.g., the gamma flattener 465 performs the gamma flattening operation before an operation of the gray mapper 460).

As illustrated in FIG. 11, a gamma characteristic of the display device 400*a* including the gamma flattener 465 may further correspond to a target gamma value of, for example, 2.2, and the display device 400*a* may have a further improved image quality.

Figure 12:
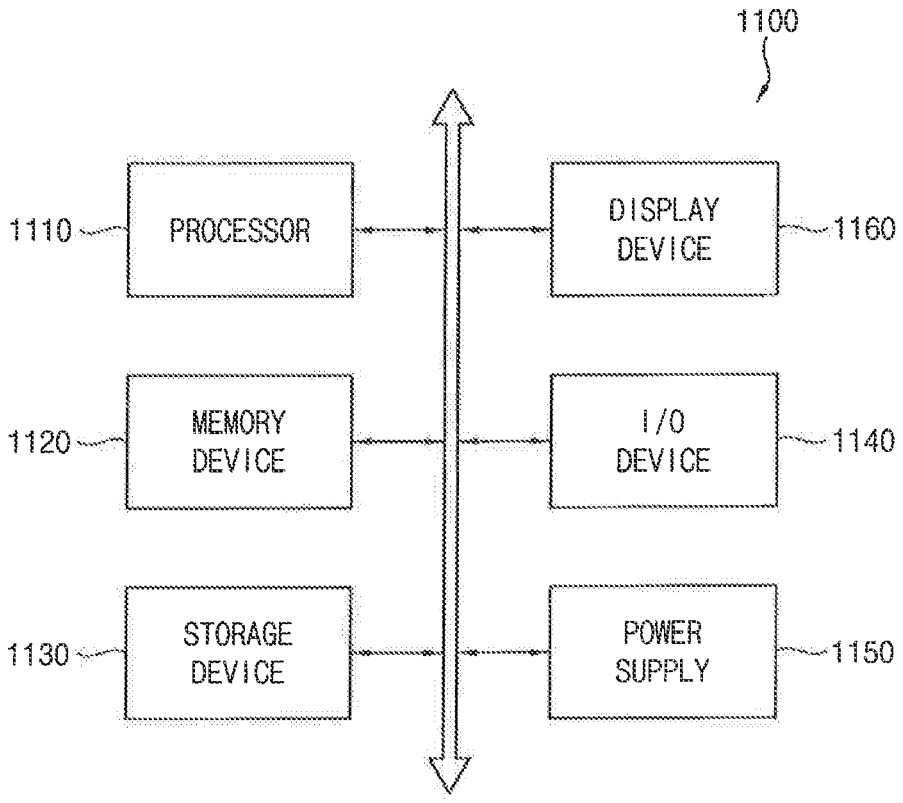
FIG. 12 is a block diagram illustrating an electronic device including a display device according to an exemplary embodiment of the inventive concept.

FIG. 12 is a block diagram illustrating an electronic device including a display device according to an exemplary embodiment of the inventive concept.

Referring to FIG. 12, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in an exemplary embodiment of the inventive concept, the processor 1110 may be further coupled to an extended bus such as a peripheral component interconnect (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100.

The display device 1160 may store gamma correction data generated by an MTP operation and reference gray mapping information generated by an AMG operation, may generate gamma corrected data voltages based on the gamma correction data, and may map original gray levels indicated by input data to gamma correction gray levels corresponding to the target gamma value based on the reference gray mapping information. Accordingly, the display device 1160 may have an improved gamma characteristic and an improved image quality.

According to an exemplary embodiment of the inventive concept, the electronic device 1100 may be any electronic device including the display device 1160, such as a cellular phone, a smartphone, a tablet computer, a wearable device, a digital television, a 3D television, a personal computer (PC), a home appliance, a laptop computer, a personal digital assistant (PDA), a portable multimedia player (PMP), a digital camera, a music player, a portable game console, a navigation system, etc.

As described above, after an operation (e.g., a multi-time programming (MTP) operation) that determines gamma reference voltages based on luminances measured at reference gray levels, the gamma correction device and the gamma correction method according to exemplary embodiments of the inventive concept may generate a lookup table storing luminances corresponding to upscaled gray levels where a dithering level of the display device is considered based on the luminances measured during the MTP operation, and may perform an operation (e.g., auto micro-adjusting gamma (AMG) operation) that adjusts each reference gray level to an upscaled gray level corresponding to a target luminance by searching the target luminance of the reference gray level corresponding to a target gamma value in the lookup table, thus improving a gamma characteristic and an image quality of the display device.

Further, the display device according to exemplary embodiments of the inventive concept may store gamma correction data generated by the MTP operation and reference gray mapping information generated by the AMG operation, may generate gamma corrected data voltages based on the gamma correction data, and may map original gray levels indicated by input data to gamma correction gray levels corresponding to the target gamma value based on the reference gray mapping information. Accordingly, the display device may have an improved gamma characteristic and an improved image quality.

While the inventive concept has been particularly shown and described with reference to exemplary embodiments thereof, it will be understood by those of ordinary skill in the art that various changes in form and details may be made thereto without departing from the spirit and scope of the inventive concept as set forth by the following claims.

What is claimed is:

1. A display device comprising:

a display panel including a plurality of pixels;

a controller configured to map original gray levels indicated by input data to gamma correction gray levels using reference gray mapping information indicating gamma correction reference gray levels to which reference gray levels are mapped, and to generate dithered output data to represent the gamma correction gray levels using the original gray levels, wherein a number of bits representing each of the gamma correction gray levels is greater than a number of bits representing each of the original gray levels; and a data driver configured to drive the display panel using the dithered output data.

2. The display device of claim 1, wherein the gamma correction reference gray levels are determined using luminances of the display device measured at the reference gray levels and a target gamma value.

3. The display device of claim 1, wherein the controller includes:

a reference gray mapping table configured to store the reference gray mapping information;

a gray mapper configured to map the original gray levels to the gamma correction gray levels using the reference gray mapping information stored in the reference gray mapping table;

a dither configured to generate the dithered output data to represent the gamma correction gray levels using the original gray levels.

4. The display device of claim 3, wherein the controller further includes:

a gamma table configured to store gamma correction data indicating gamma reference voltages at the reference gray levels that are selected among the original gray levels.

5. The display device of claim 4, further comprising:

a gamma voltage generator configured to generate data voltages respectively corresponding to the original gray levels using the gamma correction data stored in the gamma table.

6. The display device of claim 5, wherein the data driver receives the data voltages respectively corresponding to the original gray levels from the gamma voltage generator, receives the dithered output data from the dither, and provides the plurality of pixels with the data voltages indicated by the dithered output data.

7. The display device of claim 3, wherein the reference gray mapping table stores, as the reference gray mapping information, a shift sign bit and shift amount bits with respect to each of the reference gray levels.

8. The display device of claim 3, wherein the gray mapper maps the reference gray levels among the original gray levels to the gamma correction reference gray levels using the reference gray mapping information, and determines the gamma correction gray levels, to which the original gray levels between the reference gray levels are mapped, by interpolating the gamma correction reference gray levels.

9. The display device of claim 8, wherein, if a result value of the interpolation for the gamma correction reference gray levels is not representable by the dither, the gray mapper determines a gray level closest to the result value of the interpolation, among gray levels representable by the dither, as a corresponding gamma correction gray level.

10. The display device of claim 3, wherein the gray mapper includes:

a primary mapping calculator configured to map the reference gray levels to the gamma correction reference gray levels using the reference gray mapping information, and to interpolate the gamma correction reference gray levels to determine the gamma correction gray levels to which the original gray levels between the reference gray levels are mapped; and a secondary mapping calculator configured to determine gray levels closest to result values of the interpolation among gray levels representable by the dither as the gamma correction gray levels to which the original gray levels between the reference gray levels are mapped.

11. The display device of claim 3, Wherein the controller further includes a gamma flattener configured to perform a gamma flattening operation on the input data.

12. A gamma correction device for a display device, the gamma correction device comprising:

a luminance measurer configured to measure luminances of the display device at reference gray levels selected among original gray levels; and a processor configured to determine gamma reference voltages at the reference gray levels using the measured luminances, to determine upscaled gray luminances of the display device respectively corresponding to upscaled gray levels using the luminances measured at the reference gray levels, to determine target luminances of the reference gray levels using one of the luminances measured at the reference gray levels and a target gamma value, and to determine gamma correction reference gray levels to Which the reference gray levels are mapped based on the upscaled gray luminances closest to the target luminances of the reference gray levels, wherein a number of bits representing each of the upscaled gray levels is greater than a number of bits representing each of the original gray levels.

13. The gamma correction device of claim 12, wherein the processor determines the upscaled gray luminances, at the upscaled gray levels that are the same as the reference gray levels, as the luminances measured at the reference gray levels, and determines the upscaled gray luminances, at the upscaled gray levels between the reference gray levels, by interpolating the luminances measured at the reference gray levels.

14. The gamma correction device of claim 12, wherein the target luminances of the reference gray levels are determined using a luminance measured at a maximum reference gray level among the reference gray levels.

15. The gamma correction device of claim 14, wherein the target luminances of the reference gray levels are determined using an equation, "Ytgt=Ymax*(Gtgt/Gmax)^TGV", and wherein Ytgt represents one of the target luminances of the reference gray level, Ymax represents the luminance measured at the maximum reference gray level, Gtgt represents a target reference gray level, Gmax represents the maximum reference gray level, and TGV represents the target gamma value.

16. The gamma correction device of claim 12, wherein the processor generates a lookup table storing the upscaled gray luminances respectively corresponding to the upscaled gray levels using the luminances measured at the reference gray levels, and to determine the upscaled gray levels corresponding to the upscaled gray luminances closest to the target luminances in the lookup table as the gamma correction reference gray levels to which the reference gray levels are mapped.

17. The gamma correction device of claim 12, wherein the number of bits representing each of the upscaled gray levels is determined as a sum of the number of bits representing each of the original gray levels and a number of bits of dithering performed in the display device.

18. The gamma correction device of claim 12, wherein the gamma correction device writes gamma correction data, indicating the gamma reference voltages at the reference gray levels, to the display device such that the display device generates data voltages using the gamma reference voltages, and writes reference gray mapping information indicating the gamma correction reference gray levels, to which the reference gray levels are mapped to the display device, such that the display device maps the original gray levels indicated by input data of the display device to gamma correction gray levels using the gamma correction reference gray levels.

19. The gamma correction device of claim 12, wherein the processor includes:

a gamma reference voltage determiner configured to determine the gamma reference voltages at the reference gray levels;

a lookup table generator configured to generate a lookup table storing the upscaled gray luminances of the display device respectively corresponding to the upscaled gray levels;

a target luminance determiner configured to determine the target luminances of the reference gray levels; and a gamma correction reference gray determiner configured to determine the gamma correction reference gray levels to which the reference gray levels are mapped by searching the upscaled gray luminances closest to the target luminances of the reference gray levels in the lookup table.

* * * * *